US005397038A

United States Patent [19]

Hunt

[11] Patent Number: 5,397,038

[45] Date of Patent: Mar. 14, 1995

[54] EXPANDABLE GARMENT HANGER

[75] Inventor: William J. Hunt, London, England

[73] Assignee: Braitrim (UK) Ltd., London, England

[21] Appl. No.: 13,655

[22] PCT Filed: Mar. 8, 1990

[86] PCT No.: PCT/GB90/00353

§ 371 Date: Sep. 10, 1991

§ 102(e) Date: Sep. 10, 1991

[87] PCT Pub. No.: WO90/10408

PCT Pub. Date: Sep. 20, 1990

Related U.S. Application Data

[63] Continuation of Ser. No. 761,828, Sep. 10, 1991, abandoned.

[30] Foreign Application Priority Data

Mar. 10, 1989 [GB] United Kingdom ..... 8905510

[51] Int. Cl.[6] ..... A47G 25/44; A47G 25/40

[52] U.S. Cl. ..... 223/95; 223/89; D6/327

[58] Field of Search ..... 223/85, 88, 89, 94, 223/95, 96, 92; 211/113; 248/317; D6/327, 315

[56] References Cited

U.S. PATENT DOCUMENTS

| | | | |
|---|---|---|---|
| 666,235 | 1/1901 | Osgood | 223/95 |
| 1,922,858 | 8/1933 | Page | 223/85 |
| 2,332,203 | 10/1943 | Chidley | 223/95 |
| 2,477,873 | 8/1949 | Hopkins | 223/89 |
| 2,494,711 | 1/1950 | Kusher | 223/89 |
| 2,589,374 | 3/1952 | Hannon | 223/89 |
| 2,793,799 | 5/1957 | Frank et al. | 223/89 |
| 2,919,839 | 1/1960 | Burns | 223/95 |
| 3,024,954 | 3/1962 | Michlin | 223/95 |
| 3,070,269 | 12/1962 | Zuckerman | 223/88 |
| 5,044,535 | 9/1991 | Hunt | 223/95 |

FOREIGN PATENT DOCUMENTS

| | | | |
|---|---|---|---|
| 1247978 | 11/1960 | France | 223/94 |
| 1309190 | 7/1961 | France | 223/94 |
| 286192 | 7/1915 | Germany | 223/94 |
| 122478 | 8/1948 | Sweden . | |
| 823936 | 11/1959 | United Kingdom | 223/95 |

*Primary Examiner*—Clifford D. Crowder
*Assistant Examiner*—Bibhu Mohanty
*Attorney, Agent, or Firm*—Ladas & Parry

[57] ABSTRACT

An expandable garment hanger with which the invention is concerned has a body (1), a hook (2) on the body to suspend the hanger and a pair of movable arms (3,4), slidably mounted on the body. The arms are arranged to move in opposite directions. A locking device (8,9) is located on the body (1) of the hanger so as to lock the movable arms relative to the body. The locking device is movable along a path parallel to the path along which the arms are movable. A biasing device, preferably a spring (27), is provided for biasing the locking device (9,9) against movement in one direction so that when the arm of the hanger is set and locked in position the arms of the hanger are movable against the biasing force of the spring (27). The hanger conveniently supports garments of varying waist widths and maintains the hanger at the desired widths once the garment is mounted on the hanger but also allows the garment to be removed from the hanger by a small inward force applied to the end of the arm.

10 Claims, 1 Drawing Sheet

EXPANDABLE GARMENT HANGER

This is a continuation of application Ser. No. 07/761,828, filed Sep. 10, 1991, now abandoned.

BACKGROUND OF THE INVENTION

1. FIELD OF THE INVENTION

The present invention relates to expandable garment hangers.

2. DESCRIPTION OF RELATED ART

Garment hangers in which the outer ends are intended to grip waistbands of garments such as trousers and skirts are well known. It is also known for the hanger to have a structure which is used to accommodate waistbands of different sizes. However, until now it has been difficult to construct a hanger in which the full range of garment sizes from 8 to 20 can be accommodated. Hangers having varying widths have been proposed in which two gripping ends are moved in dependence one upon the other from a centre portion and locked in position against the waistband of a garment to be supported so that the hanger is maintained at its selected position. However, it is difficult to remove the garment from the hangers which have spring biased arms so as to expand the arms outwardly to accommodate various size waistbands. When a customer is selecting between two or three samples of the same garment of two or more sizes the garments are rarely replaced by the customer with the garment sizes on the hangers according to the labelling on the hanger. One typical such garment hanger is that disclosed in Applicant's prior U.S. Pat. No. 5,044,535.

There has been at least one attempt to overcome these problems by providing a garment hanger with a central guide body from which extends two movable arms, one from each end. The body has a centrally located hook and a mechanism interconnecting the arms so that movement of one arm causes movement of the other in an opposite direction. A locking device in the form of a pivotally mounted lever on the guide body on one side of its pivotal mounting engages with a series of serrations on one arm to lock the arms from movement in one direction, and on the other side of the pivot is a release lever. When pressure is applied to the release lever the portion thereof engaging the serrations disengages from the serrations to release the arms for movement in either direction.

Disadvantageously, the hanger when inserted into a garment such as a skirt sometimes lies with the bulk of the hanger inside the garment thus making it difficult to operate the locking device to release the movable arms inwardly and easily detach the garment from the hanger.

Moreover, it has been shown that customers handling the hangers in large department stores, for example, find the hanger mechanism difficult to handle in that they operate the release mechanism to remove the garment and then have difficulty in correctly replacing the garment on the hanger. Often a customer will set the hanger prior to re-fitting the garment on it and find the hanger to be too wide. The customer then has to operate the release mechanism and reset the hanger rather than simply insert the hanger into the waistband of the garment and pull the arms out to match the waistband of the garment.

Therefore, it is desirable to provide a hanger in which the above mentioned disadvantages are substantially overcome.

SUMMARY OF THE INVENTION

According to the present invention there is provided a garment hanger having a body; hook means on the body for suspending the hanger; a movable arm or arms slidably mounted on the body for free movement in opposite directions; characterised in locking means mounted on the body for locking a movable arm relative to the body against substantial movement in one direction and being movable along a path substantially parallel to the path along which an arm of the hanger is movable, the locking means extending through a slot in the body of the hanger and inwardly to engage with teeth of a ratchet on at least one of corresponding teeth on the locking means across a transverse face of the locking means and are engagable with the teeth of the ratchet for locking the or each movable arm in a selected position, the locking means being arranged to move longitudinally along the slot in the body of the hanger for release thereof from the ratchet, and biasing means for biasing the locking means against movement in one direction so that when an arm of the hanger is set and locked in position the arm or arms of the hanger at each end of the body is movable with the other arm against the biasing force of the said biasing means.

Therefore, there is disclosed in accordance with the present invention a hanger which will support garments with varying waist widths and maitain the hanger which fits the garment at the desired spacing once the garment is mounted on the hanger, but also allow the garment to be removed from the hanger by a small inward force applied to the end of the arm. Conveniently, the hanger has a central guide body of a width at least no greater than the minimum width of the desired range of garments.

The garment locking means on the central guide body is arranged to lock each of the arms at selectable positions against substantial movement in both outward and inward directions of said arms. The locking means preferably comprises a series of notches or teeth on one movable arm which are arranged to be engaged by at least one stop on the central guide body to locate and lock each arm in a selectable series of positions but also to allow a small amount of resilient movement in the arms at each selected position. The small amount of resilient movement is determined by the compressibility of the spring bias against the stop.

Conveniently, the locking means comprises a ratchet on the upper or lower sides of one arm engagable with a locking plate on the guide body. Alternatively, each of the movable arms can be provided with a form of ratchet which is engagable with the locking plate conveniently located on the guide body, for example at one or each end of the guide body.

Preferably, the innermost end of each arm is provided with a toothed or geared portion engaging with a centrally located gear wheel rotatably mounted on the central guide body so that movement of one arm inwardly or outwardly inherently moves the other arm in the opposite direction so that both arms move either inwardly or outwardly together.

In one preferred embodiment the locking means comprises an elongate plate located on the body with its longitudinal axis extending transversely to the direction of movement of the movable arms. The locking plate extends outwardly of the hanger through the slot in the body of the hanger and inwardly to engage with the teeth of a ratchet on the movable arm. The locking plate is provided with teeth across a transverse face thereof to engage with the teeth of the ratchet and thereby lock the movable arm in a selected position.

The locking plate is arranged to move longitudinally along the slot in the body of the hanger. Preferably the plate is biased towards one end of the slot by a spring, preferably the outermost end of the slot relative to the hook.

DESCRIPTION OF THE PREFERRED EMBODIMENTS

Figure 1:
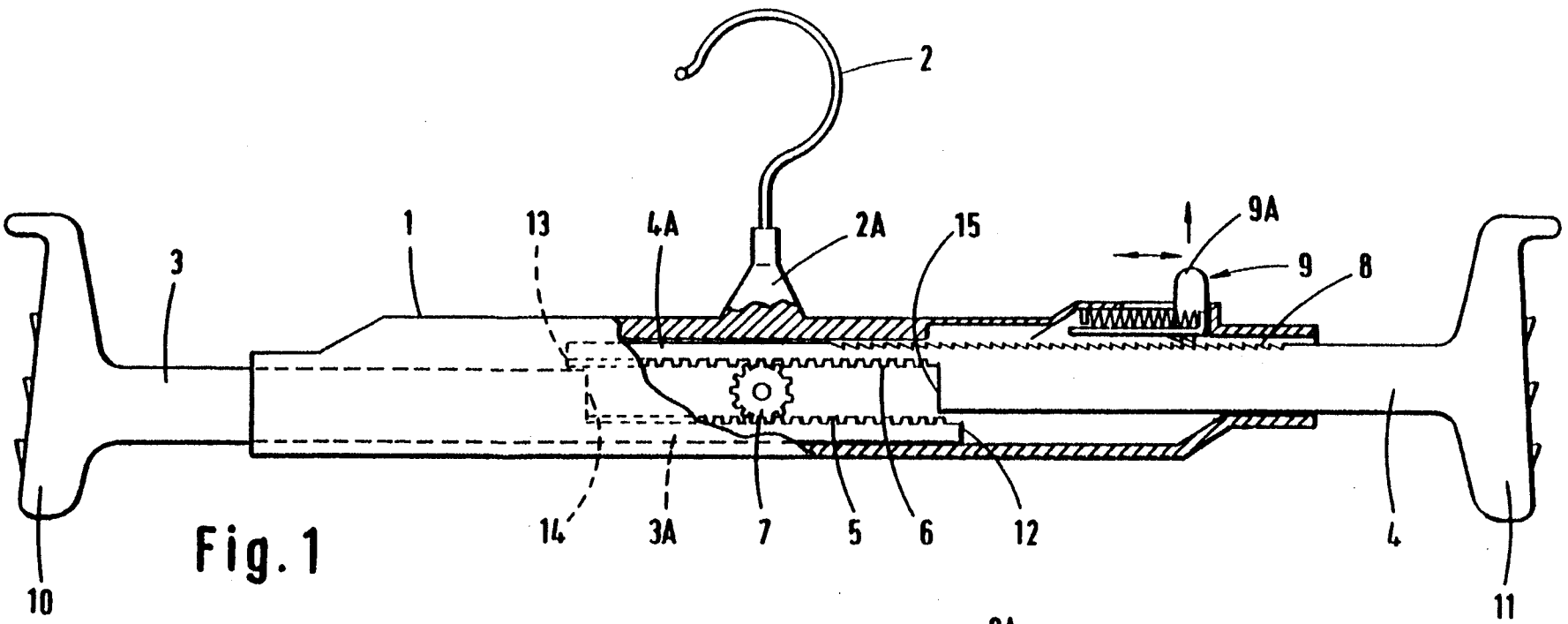
FIG. 1 is a partial side elevational view of an expandable garment hanger according to the present invention.

Referring specifically to the drawing, an expandable garment hanger is provided comprising a central hollow guide body 1 having a centrally located hook 2 for suspending the hanger, which hook is rotatably mounted in a bush 2A of the guide body 1. Two arms 3, 4 are each slidably mounted within the hollow guide body 1 and the innermost end of each arm has a part 3A, 4A of reduced width on which is located a gear toothed portion 5, 6 respectively, extending inwardly along each of the arms. A gear wheel 7, rotatably mounted centrally within the guide body 1 is engaged with each of the toothed portions 5, 6. Consequently, movement of one of the arms 3, 4 in one direction by reason of interaction between the respective gear toothed portion 5, 6 and wheel 7, moves the other arm in the opposite direction. The outer end of each arm 3, 4 is provided with a garment gripping device 10 and 11 which are angled relative to the longitudinal axis of the arms 3, 4 to prevent a garment slipping off the hanger in use.

Figure 2:
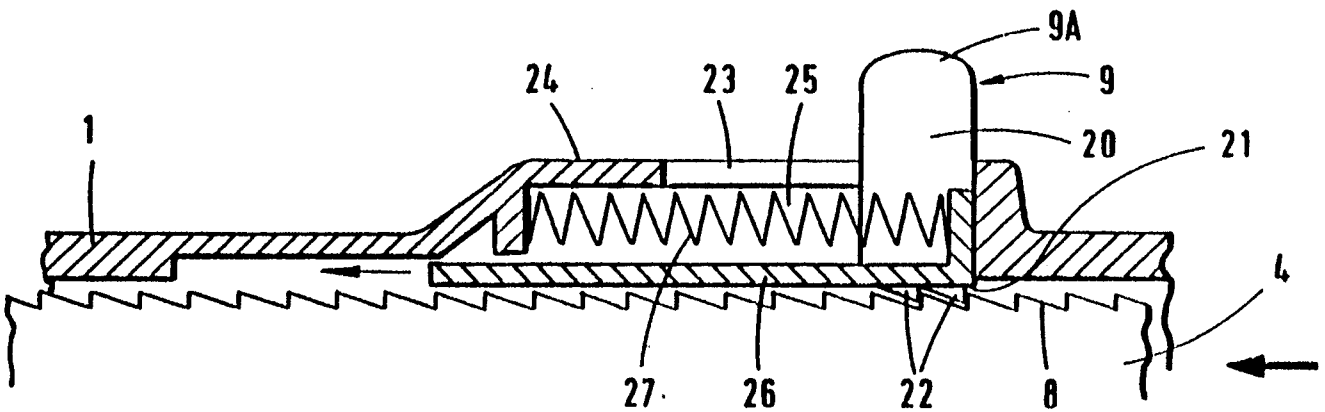
FIG. 2 is a fragmentary view of part of the hanger of FIG. 1.

One of the arms 4 is provided with a ratchet portion 8 comprising a plurality of teeth being located along the upper surface thereof as shown in FIGS. 1 and 2. The corresponding end of the guide body 1 has a stop 9 for locking engagement with ratchet teeth 8. The end of the stop 9 remote from that end 9A which projects outwardly of the central guide body 1 is correspondingly toothed and free to move upwardly and downwardly so these teeth engage or disengage with the teeth on the ratchet 8.

The stop 9 comprises a short, elongate flat sided tab or plate the length of which is longer than the width of its flat side 20. Innermost face 21 of the stop 9 is provided with sawtooth shaped teeth 22 which interengage with the teeth 8 on arm 4 to prevent substantial inward movement of the arms 3, 4 whilst allowing free outward movement thereof.

The uppermost part of the stop 9 projects through a slot 23 provided in a raised housing portion 24 on the guide body 1. The housing 24 defines a space 25 therein which is bounded on one side by an L-shaped retainer or locking plate 26 attached to the stop 9 at the innermost end of the stop with the longer side of the L lying in a plane parallel to the path in which the arms 3, 4 are movable. A spring 27 is located within space 25 as defined by the housing portion 24 and the retainer 26. The spring is a coil spring and the closeness of the walls of the housing prevent the spring from distorting laterally when compressed. However, there is sufficient room in space 25 for the tab 9 to be held and pulled upwardly to disengage teeth 22 from ratchet teeth 8.

The teeth 22 of the stop 9 remain in engagement with the ratchet teeth 8 on the arm 4 during compressibility of the arms 3, 4 towards each other thereby providing the arms with a relatively small degree of resilience under the force applied by the spring 27 even though the arms 3, 4 have been generally set for a particular size of garment. The amount of movement is determined by the amount the spring will compress. In the present instance the spring will allow the stop 9 to move approximately, for example, 12 mm resulting in 48 mm of slack in the garment waistband.

In operation the hanger is set to receive a garment having a particular size of waistband, for example, by pulling outwardly on one end of one arm 3, 4 whereupon the other arm moves accordingly because of the interconnection between the arms by gear wheel 7. Once the garment hanger is at the correct width for a particular sized garment one end of the hanger is placed within the garment against the waistband. The opposite end of this hanger having stop tab 9 is forced inwardly against the biasing force of spring 27 for a very short distance relative to the full movement of the arms 3, 4 in the central guide body 1, to allow the opposite end of the hanger to be inserted into the waistband. The arm is released and expands under the force of spring 23 to fit tightly into the waistband but with the stop 9 substantially against the end of the slot remote from the hook 2.

The resilience in the relatively fixed arms of the hanger is useful when a customer removes and replaces the garment on the hanger when trying on the garment by the appropriate inward movement of the arms against the influence of the spring 27. However, the garment may not be placed on another hanger set for a different size of garment unless the hanger is reset since inward movement of the arms is relatively small.

In describing the operation of the hanger it is assumed the arms 3, 4 are in their most inwardly position in which free ends 12, 13 of overlapping portions 3A, 4A overlie end walls 15, 14, respectively, of the opposite arm.

The expandable garment hanger is then placed inside the waistband of a garment such as a skirt or a pair of trousers with, garment gripping device 10 against the waistband. The arm 4 is pulled outwardly of the central guide body 1 until the garment gripping device 11 engages the opposite side of the waistband. As the arm 4 moves outwardly the arm 3 automatically moves outwardly until the waistband of the garment is at full width and supported on the hanger. The teeth on stop tab 9 then engage the ratchet teeth 8 and prevent inward movement of the arms 3, 4 thus ensuring the garment is securely supported at its waistband without stretching or distorting the garment.

The garment is removable from the hanger by applying pressure upon the ends of the arms inwardly towards the centre of the hanger and against spring 27. Alternatively, the tab 9 is pulled upwardly or pushed upwardly to release teeth 22 from ratchet teeth 8 whereupon the arms of the hanger are movable inwardly.

Whilst the present invention has been described with reference to a locking tab located towards one end of the hanger, such a locking tab can be provided at both ends of the garment hanger, either along the top of the hanger or along the side face of the hanger. In the latter instance the ratchet teeth on the arm are also on the side face thereof adjacent to the side face through which the stop tab 9 projects.

In a further alternative expandable garment hanger according to the present invention the movement of the arms 3, 4 is obtained by replacing the gear toothed portion and wheel by a lever pivotally mounted between opposite ends thereof, and connected at the opposite ends to a respective one of the inner ends of the arms 3, 4.

Therefore, there has been described a hanger in which the locking stop comprises an arm slidably mounted on the guide body and having a series of notches or teeth on an end face of the locking stop, which teeth are arranged to engage with at least one tooth on the movable arm substantially to lock the arm in a selected series of positions.

A ratchet may be provided on the upper and lower sides of the movable arm engagable with a stop member on one or each end of the central guide body.

Conveniently, the body comprises a central guide of a width at least no greater than the minimum width of the desired range of garments, two arms mounted in the central guide body for slidable movement in opposite directions relative to each other, a garment gripper at a free outermost end of each arm. The locking stop is provided on one or both arms of the central guide body to lock each of the arms at selected positions against inward movement of said arms.

In a further alternative arrangement one arm can be fixed or adjusted independently with its own locking device (without the centre gear wheel) and the other arm move inwardly and outwardly as substantially described previously including the spring locking arrangement.

I claim:

1. In a garment hanger having a body with an elongated slot, hook means on the body for suspending the hanger, a movable arm slidably mounted on the body for free movement in opposite directions, and locking means mounted on the body for locking said movable arm relative to the body against movement in one direction, a locking device having teeth, the locking means including a ratchet on said arm engagable by said teeth, the improvement being in the locking device being movable along a path substantially parallel to the path along which said arm of the hanger is movable, the locking device extending outwardly through said elongate slot in the body of the hanger and inwardly to engage said ratchet on the said arm in a selected position, the locking device being movable longitudinally along the slot in the body of the hanger for release thereof from the ratchet, and biasing means engagable with the locking device for biasing the locking device against movement in one direction so that when said arm of the hanger is set and locked in position the arm of the hanger is movable against the biasing force of the said biasing means.

2. The hanger as claimed in claim 1, wherein the locking means comprises a ratchet on the upper or lower side of said arm engagable with a locking plate on the body.

3. The hanger as claimed in claim 2, wherein the hanger has two arms movable together in opposite directions, each movable arm being provided with a ratchet.

4. The hanger as claimed in claim 3, wherein the lockable plate is located at one or each end of the body for engagement with the ratchet of one of the movable arms.

5. The hanger as claimed in claim 3 wherein interengaging means between the movable arms comprises a toothed wheel rotatably mounted on the body, which is engagable with a toothed portion on each arm.

6. The hanger as claimed in claim 1, wherein the biasing means comprises a spring to force the locking device outwardly of the hanger along a path parallel to the path of movement of the arm of the hanger.

7. A garment hanger having a body, hook means on the body for suspending the body, a movable arm longitudinally, slidably, mounted on the body for movement in a longitudinal direction, locking means capable of locking the movable arm relative to the body in any selected longitudinal position against inward movement in a longitudinal direction and biasing means for biasing the locked arm against inward longitudinal movement of the arm so that when the arm is locked in its selected locked position the arm is inwardly movable by a limited amount against the biasing force of the biasing means to reduce the width of the hanger to enable removal of a garment hung on the garment hanger.

8. The hanger as claimed in claim 7, wherein the locking means comprises a ratchet on the upper side of the movable arm engagable with a locking plate on the guide body.

9. A hanger as claimed in claim 7, wherein the biasing means comprises a spring which is located against the locking device for biasing the locking device and movable arm in a direction substantially parallel to the longitudinal axis of the movable arm of the hanger.

10. A hanger as claimed in claim 7, wherein the hanger has two movable arms.

* * * * *